US007298368B2

(12) United States Patent
Anderson et al.

(10) Patent No.: US 7,298,368 B2
(45) Date of Patent: Nov. 20, 2007

(54) DISPLAY DEVICE HAVING A DAC PER PIXEL

(75) Inventors: Daryl E. Anderson, Corvallis, OR (US); George H Corrigan, III, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 779 days.

(21) Appl. No.: 10/803,635

(22) Filed: Mar. 17, 2004

(65) Prior Publication Data

US 2005/0206631 A1 Sep. 22, 2005

(51) Int. Cl.
*G09G 5/00* (2006.01)
*G09G 3/30* (2006.01)
*G09G 3/36* (2006.01)

(52) U.S. Cl. ..... 345/205; 345/76; 345/90

(58) Field of Classification Search ..... 345/76, 345/90, 204, 205, 98, 100
See application file for complete search history.

(56) References Cited

U.S. PATENT DOCUMENTS

| | | | | |
|---|---|---|---|---|
| 5,959,598 | A * | 9/1999 | McKnight | 345/90 |
| 5,977,940 | A * | 11/1999 | Akiyama et al. | 345/94 |
| 6,014,193 | A * | 1/2000 | Taira et al. | 349/73 |
| 7,038,641 | B2 * | 5/2006 | Hirota et al. | 345/83 |
| 7,068,251 | B2 * | 6/2006 | Lin et al. | 345/87 |
| 7,170,485 | B2 * | 1/2007 | Huang | 345/98 |
| 7,224,339 | B2 * | 5/2007 | Koyama et al. | 345/98 |
| 2002/0041266 | A1 | 4/2002 | Koyama et al. | |
| 2002/0075208 | A1 | 6/2002 | Bae et al. | |

* cited by examiner

*Primary Examiner*—Sumati Lefkowitz
*Assistant Examiner*—Rodney Amadiz

(57) ABSTRACT

An embodiment of the invention is a display device including a plurality of pixels. The pixels in the display include an optical part. There is a digital-to-analog converter for driving the optical part. The digital to analog converter is physically co-located the optical part. Driving circuitry provides digital signals simultaneously to digital-to-analog converters for the plurality of pixels.

14 Claims, 5 Drawing Sheets

DISPLAY DEVICE HAVING A DAC PER PIXEL

FIELD OF THE INVENTION

The invention is in the display device field. The invention particularly concerns display drivers.

BACKGROUND OF THE INVENTION

Display devices for computer-driven and computer-assisted applications are in widespread use. Display devices now range is size from the very small, e.g., for handheld devices, to the very large, e.g., for large displays in conference halls and public spaces, both indoor and outdoor.

Challenges presented by very large display devices include the need for very high frequency signals to drive them. For example, a thin-film transistor ("TFT") display device with a rectilinear configuration of 1,000×1,000 picture elements ("pixels," an element of a visual image or picture), using a typical "row, column" addressing scheme, 256 intensity values and displaying 72 frames/second would require a driving signal frequency of (1,000 rows×256 intensity levels×72 frames/second)≈18.4 MHz, and 256 time intervals per frame are required to achieve 256 intensity levels. The 256 time intervals are required because one time interval is required to send either a 1 or a 0, the total of 256 of which bits represents the desired intensity for a given frame distributed time-wise through the frame to reduce artifacts.

Very high frequency signals can present design, operation and control issues. One such issue that becomes important at high frequencies is the effect of electromagnetic interference ("EMI"). This may be particularly important to consider in larger display devices because the required long electrical traces act as antennae. It would be beneficial to drive a given display with lower frequency signals and yet produce the same number of intensity levels, frames/second, etc.

SUMMARY OF THE INVENTION

An embodiment of the invention is a display device including a plurality of pixels. The pixels in the display include an optical part. There is a digital-to-analog converter for driving the optical part. The digital to analog converter is physically co-located the optical part. Driving circuitry provides digital signals simultaneously to digital-to-analog converters for the plurality of pixels.

DETAILED DESCRIPTION

Figure 1:
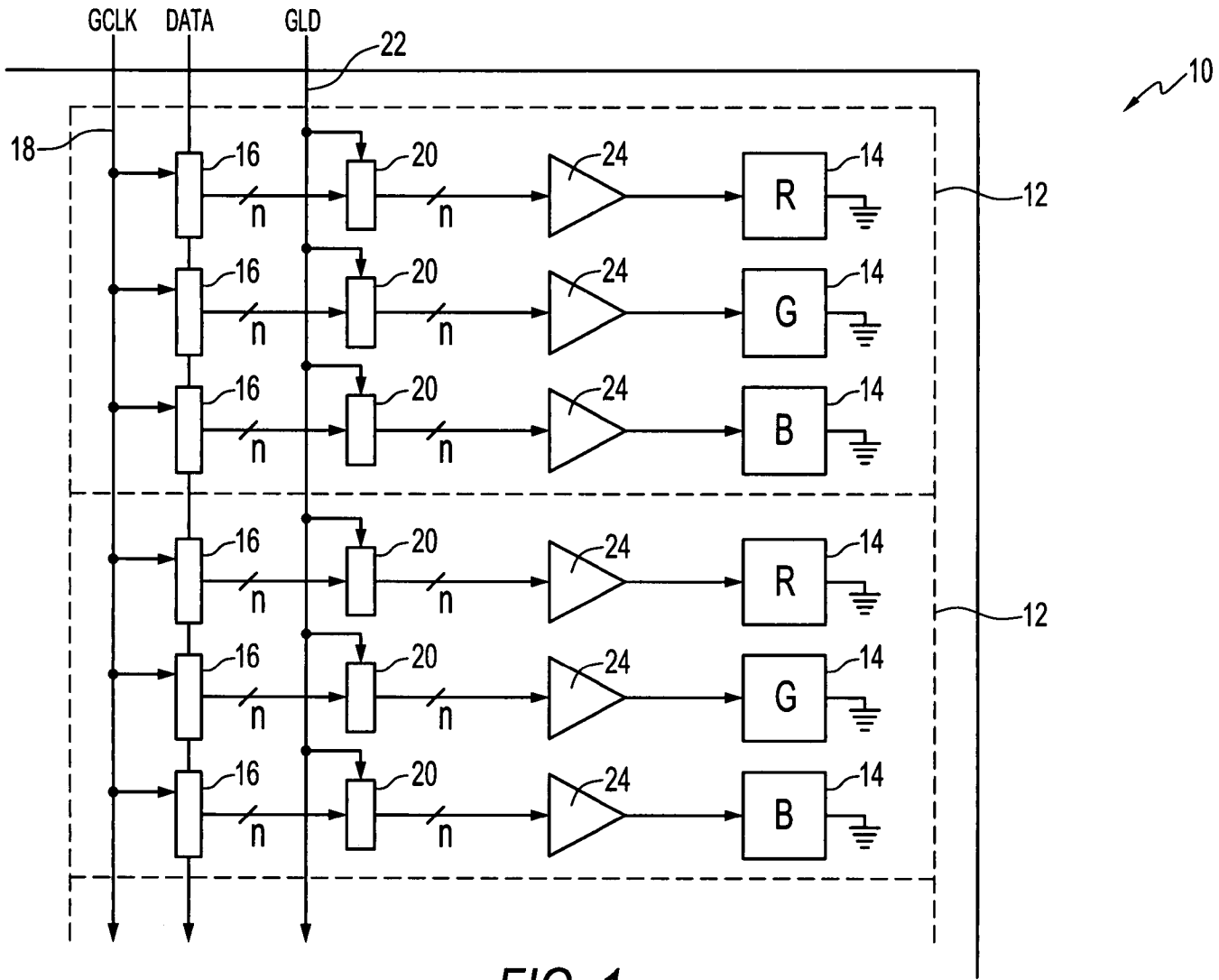
FIG. 1 is a partial schematic diagram of an exemplary display device according to an embodiment of the invention.

The present invention is directed to display devices, methods for driving display devices, and methods of making display devices. An exemplary apparatus embodiment of the invention includes driving circuitry and a digital-to-analog converter ("DAC") co-located with the optical part of a pixel in a display.

As used herein, "pixel" encompasses both a picture element that includes a single optical part for the display of a single color and a picture element including a plurality of optical parts for the display of one or more colors, sometimes referred to in the art as a "superpixel". A preferred pixel of the invention is a tri-color pixel, as current color science and management makes prevailing use of a tri-color scheme. For example, in a display using the red-green-blue ("RGB") color scheme, a pixel (also called a superpixel) would include at least one distinct optical part for displaying each color, e.g., red, green and blue. Also, while the RGB color scheme is used as an example, other color schemes are possible and within the scope of the invention. The invention is well-suited to any multi-color scheme, and will apply equally as color science changes, for example as new physical display elements and combinations develop. Artisans will accordingly appreciate that the exemplary tri-color pixels and exemplary color management schemes in the preferred embodiment serve as an illustration of multi-color pixels in making use of any color science and any color management scheme.

"Optical part," as used herein, encompasses a physical element that transmits or produces a display. This includes, for example, emissive, transmissive, and reflective elements. An example emissive element is a light emitting diode, including, for example, an organic light emitting device (OLED). An example transmissive element is a masking element, such as an element in a liquid crystal array used to selectively pass or block light. Example reflective elements are a digital micro mirror device (DMD) and a diffractive light device (DLD).

An exemplary method embodiment of the invention includes loading digital data serially into respective serial shifters of a plurality of pixels, where the digital data include a plurality of bits. The digital data is loaded simultaneously into respective parallel data latches of the plurality of pixels. Conversion of the digital data into analog signals occurs simultaneously in the pixels. The analog signals are sent to optical parts of the pixels to cause a display. Embodiments of the invention allow a reduction in the number of bits required to define an intensity level within a set of intensity levels, permitting operation of a display at relatively lower frequencies. Embodiments of the invention also feature displays including an array of pixels in two dimensions, e.g., in rows and columns, without the display space being taken up by circuitry for connecting the pixels in implementation of the invention. In a typical row-and-column array, there are drivers for both the rows and the columns. This driving circuitry occupies array surface area on both the top and on at least one side of the typical row-and-column array, which limits the ability to abut panels side-by-side without a gap or gaps in the total display area.

Skilled artisans will recognize that the present invention is not limited to any given display geometry. An example embodiment is a rectilinear configuration with rows and columns of pixels (with rows being horizontal bands and columns being vertical bands of pixels with reference to the usual orientation of the display). Another example is a round configuration with concentric bands of pixels, or other configurations of pixels in a display. Many other example geometries will be apparent to artisans.

The invention will now be illustrated with respect to exemplary embodiment devices. Methods of the invention will also be apparent from the following discussion. In describing the invention, particular exemplary devices will be used for purposes of illustration. The drawings are not to scale. Illustrated devices may be schematically presented, and exaggerated for purposes of illustration and understanding of the invention.

Turning now to the figures, FIG. 1 is a schematic diagram of a portion of an exemplary embodiment display 10 of the invention, formed of a plurality of pixels arranged in an arbitrary geometric configuration, for example, in a rectangular arrangement where pixels may be addressed as rows and columns. FIG. 1 shows a portion of the display 10 including two pixels 12. While two pixels 12 are shown, the display may include a very large number of pixels. As an example, a display capable of presenting an HDTV image may have 2,073,600 pixels (in the 1080i format). The pixels in the display are arranged into groups, for example rows.

Each of the pixels 12 includes three optical parts 14, for example red, green, and blue emissive elements and driving circuitry. Each optical part 14 can produce a display according to a specified, settable intensity. Data bits are received by serial shifters 16, forming part of the driving circuitry. The connection of a plurality of serial shifters 16 of multiple pixels defines a group of pixels, for example a row in a rectilinear display, that receives a data set by a serial shift of bits beginning at one end of the serially-connected serial shifters 16 one bit at a time until each shifter 16 in the group of pixels receives a byte of data. In the exemplary embodiments, the shifters each hold a byte of 8 bits, but artisans will appreciate that the principle is generally extendible to n bits, where n is greater than 1 and is preferably at least 8. The number n influences the number of potential distinct intensity levels available to be displayed from corresponding optical parts 14. In the example where n=8, there are 256 potential intensity levels that may be set for each optical part.

By shifting data into the serial shifters, there is no need to include addressing data for pixels 12 (or optical parts). A simple serial data shift into the group of pixels provides a data byte for each optical part 14 in the group of pixels. The shifting occurs in accordance with a global clock signal (GCLK) on a global clock line 18. In an example embodiment, a data set advances one bit per clock cycle into the serial shifters 16. Taking the example of a rectilinear display, a data set would shift into each row, for example in accordance with the signal GCLK in each of the rows of the display.

Once shifting of a data set has been completed, a data byte (for example 8 bits) for each optical part 14 is moved into a respective data latch 20 (forming part of the driving circuitry) in accordance with a global load signal (GLD) provided on a global load line 22. When a data latch loads a new byte of data it applies a previous byte of data to a respective digital to analog converter (DAC) 24, a final part of the driving circuitry in the exemplary FIG. 1 embodiment. Each DAC 24 drives a respective optical part 14 based upon data that had been shifted into a corresponding serial shifter 16 and latched by a corresponding latch 20. The GLD signal is provided after a predetermined number of GLCK cycles, and after a load into data latches 20, the cycle of shifting a new data set into the serial shifters 16 begins again. In an embodiment of the invention, the optical parts 14 are emitting parts, such as light emitting diodes, and in other embodiments of the invention the optical transmissive parts that selectively transmit light or reflecting parts that reflect light emitted from a source that may not be included in the pixels 12. In preferred embodiments, the display 10 is an integrated circuit, and with an architecture in accordance with FIG. 1. The driving circuitry, including the DACs, serial shifters, and data latches are physically co-located in the pixels, with the optical parts 14.

The digital to analog conversion occurs in the pixels, subsequent to the data being shifted to the pixels. For an exemplary display device embodiment of the present invention with a rectilinear configuration of 1,000×1,000 pixels, using a typical "row, column" addressing scheme and groups of 8 bits to define $2^8$ or 256 intensity values and displaying 72 frames/second would require driving signal frequency of (1,000 rows×8 bits×72 frames/second)=576 KHz, and only eight time intervals per frame are required to achieve 256 intensity levels.

Skilled artisans will recognize that the items included in the pixels 12 may be implemented in a number of ways. Without intending to limit the scope of the invention, these implementations include the following without excluding others not mentioned herein. In an embodiment of the invention, the serial shifters 16 may be implemented based on charge-coupled-device logic or chains of transmission gates and inverters. In an embodiment of the invention, the parallel data latches 20 are latches, which may be implemented, e.g., as capacitors. In an embodiment of the invention, the DACs 24 may be implemented, e.g., as a resistor ladder or as a set of binary resistors. A preferred embodiment is based on complementary metal-oxide semiconductor ("CMOS") technology. In an embodiment of the invention, the optical parts 14 may be implemented as light emitting devices, e.g., light emitting diodes ("LED"), an organic light emitting diodes ("OLED"), or as light reflecting devices, e.g., digital micro-mirrors ("DMD"), such as those available from Texas Instruments, or some combination of different kinds of optical parts, such as a combination of radiation and reflection devices.

Figure 2:
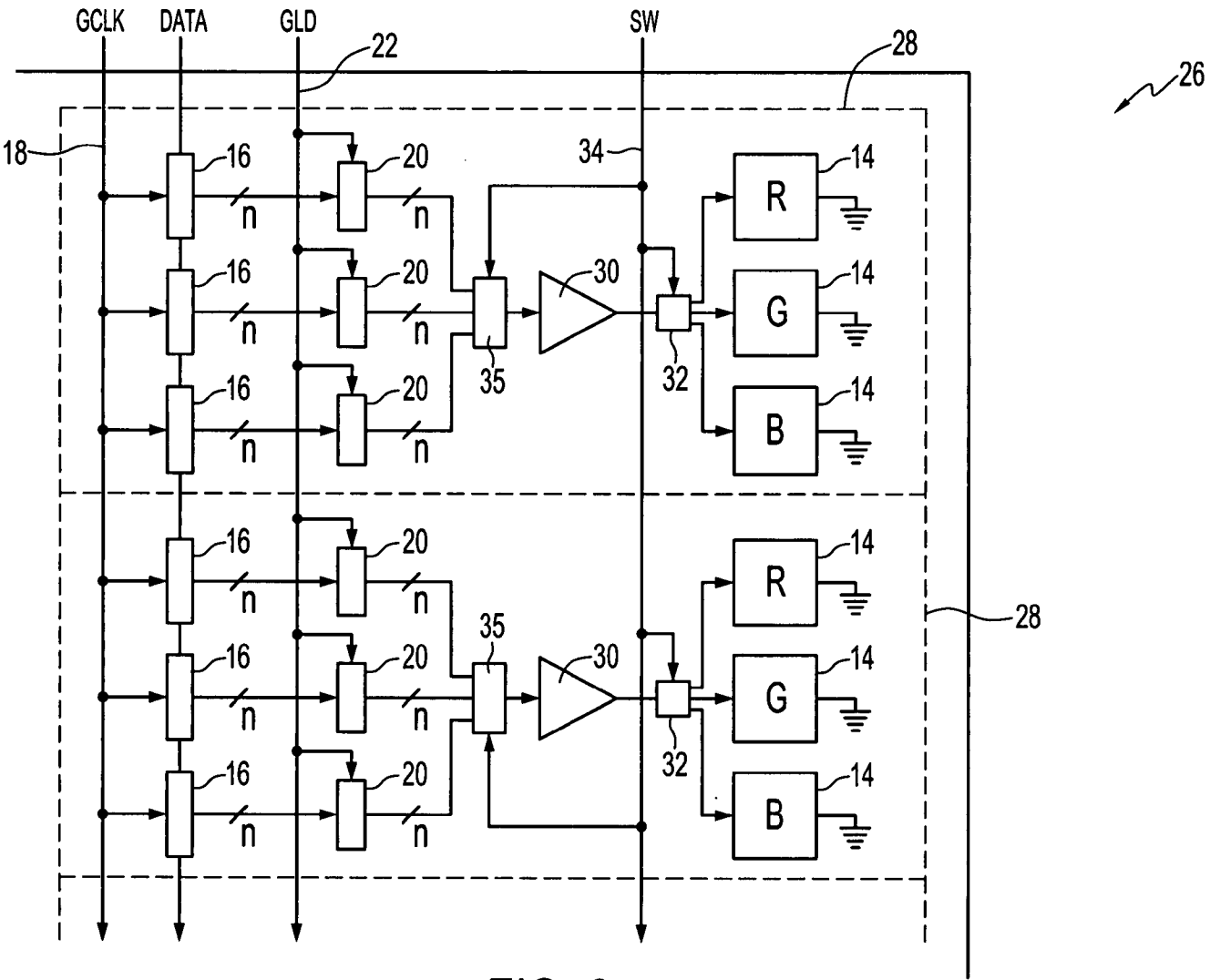
FIG. 2 is a partial schematic diagram of an exemplary display device according to an embodiment of the invention.

FIG. 2 is a schematic diagram of a portion of another exemplary embodiment display 26 of the invention. The FIG. 2 device includes optical parts 14, serial shifters 16, and latches 20 that are the same as in the FIG. 1 embodiment, with shifting and loading also being conducted with the GCLK and GLD signals on the global clock and global load lines 18, 22. Unlike the FIG. 1 embodiment, pixels 28 each include one DAC 30 instead of one DAC for each optical part 14. A switch 32 cycles according to color phases to sequentially and individually apply the output of the DAC 30, for example, separate R, G, and B signals to the respective optical parts. The switch 32 is controlled by a switch signal SW provided on a switch line 34 that also controls a switch 35 to individually apply the correct data from respective latches 20 to the input of the DAC 30. Alternatively, a separate signal may be used to control the input to the DAC 30, but there must be synchronization between the selection of a latch 20 by the switch 35 and the selection of the optical part 14 by the switch 32 so that the intensity data is correctly applied. Namely, the data stored in a given latch 20 must be applied to a corresponding optical part 14 (e.g., so that data corresponding to the intensity of red, e.g., is applied to a red optical part). The SW signal is at a higher frequency than the load signal so that data from each of the three latches 20 in each pixel may be applied to a corresponding optical part 14.

Figure 3:
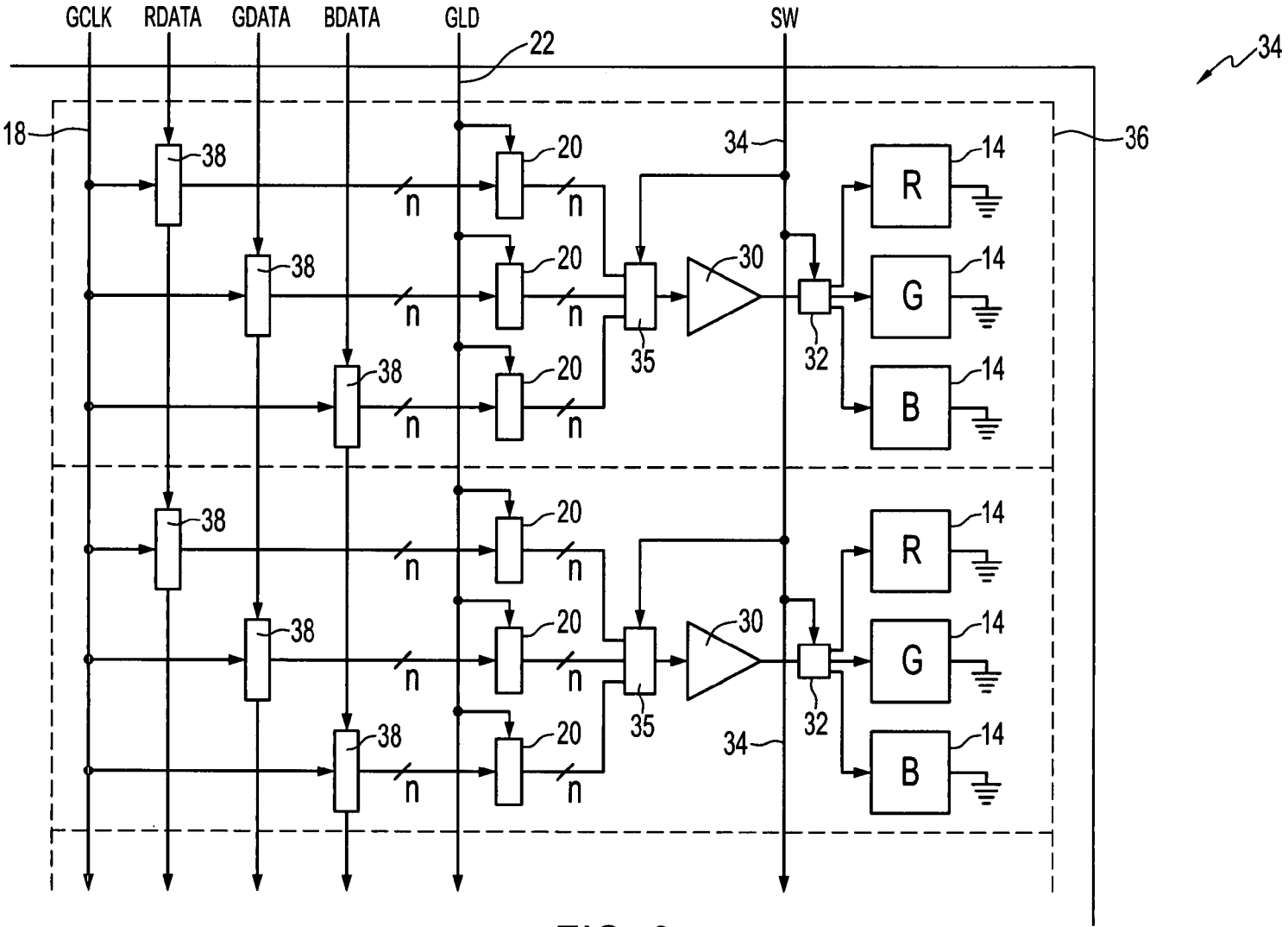
FIG. 3 is a partial schematic diagram of an exemplary display device according to an embodiment of the invention.

FIG. 3 is a schematic diagram of a portion of another exemplary embodiment display 34 of the invention. Pixels 36 in the display 34 use switches 32 and 35 to cycle through color phases as in the FIG. 2 embodiment. In the FIG. 3 embodiment, however, serial shifters 38 are segregated according to color so that data may be serially shifted in parallel. For a three color display, as in the FIG. 3 example, the number of cycles for the GCLK signal to load an entire data set (for example a row) is a third of that required for the FIGS. 1 and 2 embodiments because of the separate RDATA, GDATA, and BDATA channels. Otherwise, however, the loading and latching occurs in the same fashion as in the FIGS. 1 and 2 embodiments.

Figure 4:
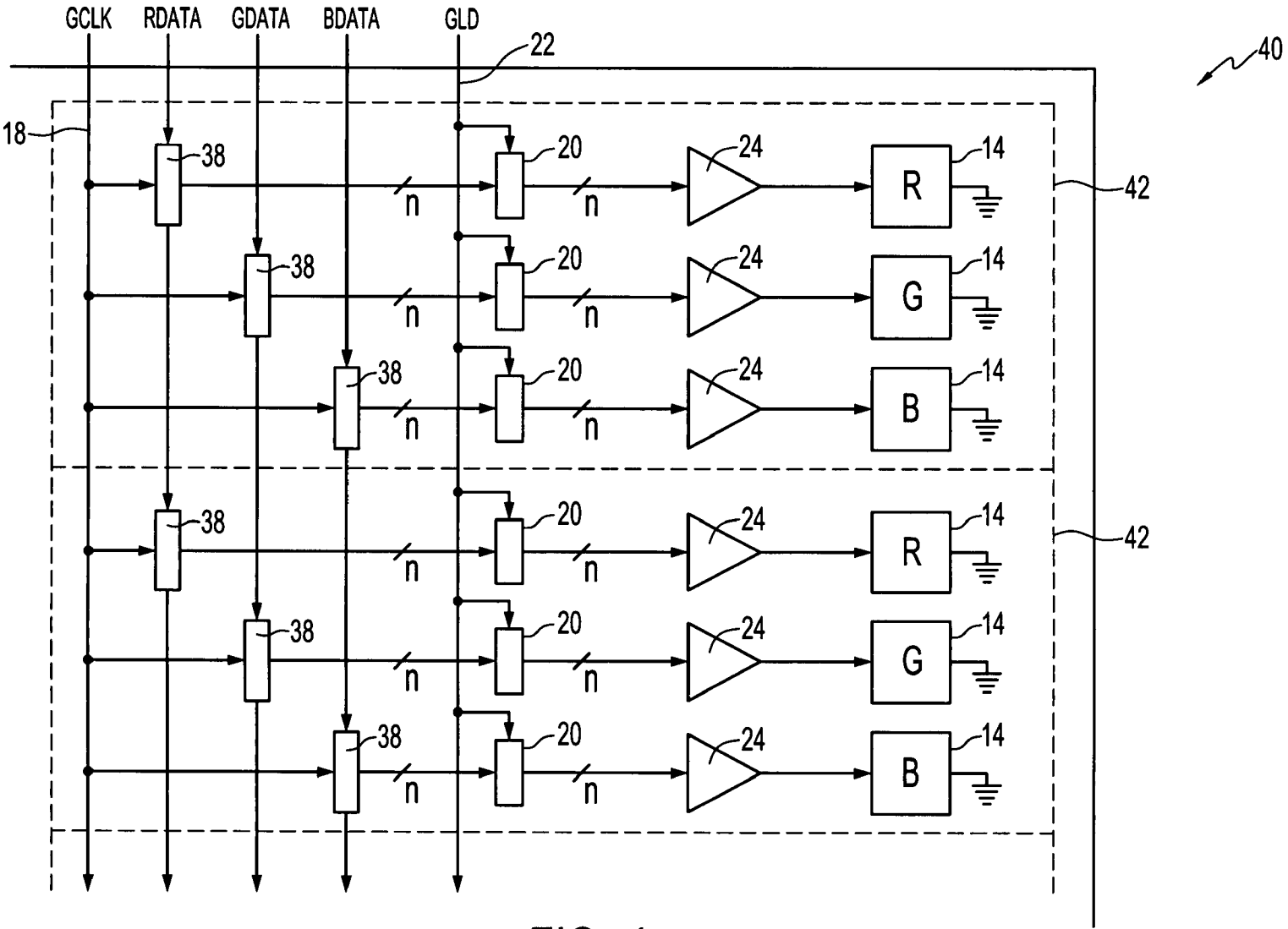
FIG. 4 is a partial schematic diagram of an exemplary display device according to an embodiment of the invention.

FIG. 4 shows yet another embodiment display 40. The FIG. 4 embodiment includes parallel data shifting as in the FIG. 3 embodiment. However, it includes a DAC for each optical part 14 in pixels 42, in like fashion to the FIG. 1 embodiment. Like parts of FIG. 4 are labeled with the common reference numbers from FIGS. 1 and 3. The display 40 of FIG. 4 achieves the parallel loading of data sets for different colors into the serial shifters 38, while also achieving the simultaneous driving of different colored optical parts, each of which has a corresponding DAC 24. The FIG. 4 embodiment accordingly achieves the one third savings (compared to the embodiments of FIGS. 1 and 2) in the number of the GLCK signal to load an entire data set, as in FIG. 3. The display 40 of FIG. 4 also achieves the parallel driving of optical parts corresponding to different colors provided by FIG. 1, obviating the need to multiplex the DAC output as is done with the color switches in the FIGS. 2 and 3 embodiments.

Artisans making use of the invention will accordingly appreciate that the features of the exemplary embodiments may be selected and combined to achieve a particular design goal. The various features may be adapted to minimize the number of circuits used, to maximize the speed of the display, or to achieve a metric that balances both.

Figure 5:
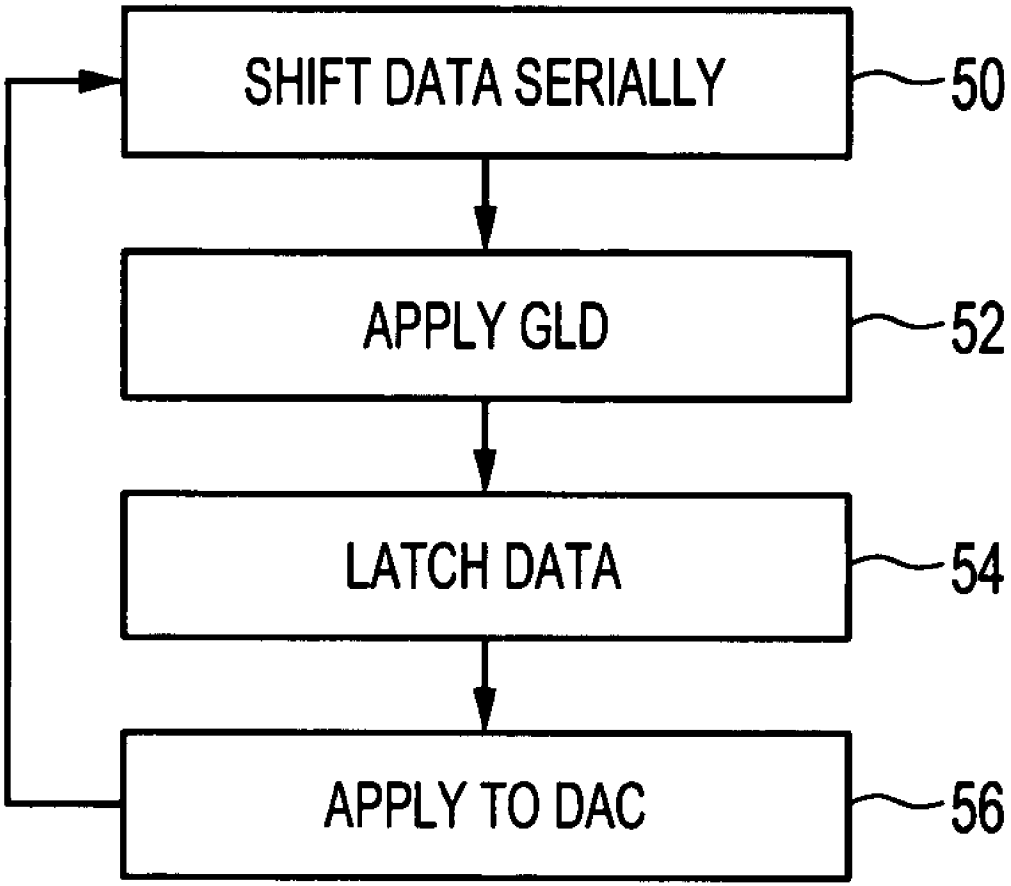
FIG. 5 is a flow chart depicting an exemplary method embodiment of the present invention.

FIG. 5 is a flow chart depicting the steps of an exemplary method of the invention, applicable to the exemplary embodiment displays. In FIG. 5, the digital data is shifted serially (step 50) into respective serial shifters. In the case of FIGS. 1 and 2, each data set loaded includes data for multiple color channels, while application of the method to the displays of FIGS. 3 and 4 has data being shifted serially on separate color lines. When data shifting has been completed, a GLD signal is applied (step 52). Application of the GLD signal causes the data in the serial registers to latch (step 54) and simultaneously, the previous data set from the latches is applied to the DAC (step 56). The application to the DAC will involve switching, in the case of the FIGS. 2 and 3 embodiments, as described above.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A display device comprising a plurality of pixels, each pixel in the display comprising:

a serial shifter that accepts a serial bit stream and has an n-bit wide output;

an n-bit wide data latch that latches data received from the output of the serial shifter; wherein each pixel comprises:

a plurality of optical parts;

a data latch corresponding to each optical part;

a digital to analog converter for each of said plurality of optical parts to which output of the respective data latch is applied, wherein each optical part is driven by the digital to analog converter; and a serial shifter corresponding to each optical part.

2. The display device of claim 1, wherein said serial shifters in each pixel are arranged to receive data in parallel.

3. The display device of claim 1, wherein groups in the plurality of pixels comprise interconnected serial shifters to serially receive a data set.

4. The display device of claim 3, further comprising a global clock line to control shifting of data through interconnected serial shifters of groups of pixels in the plurality of pixels.

5. The display device of claim 4, further comprising a global load line to control latching of data by data latches in the plurality of pixels.

6. The display device of claim 1, wherein said optical part comprises a light emitter.

7. The display device of claim 6 wherein said light emitter comprises a light emitting diode.

8. The display device of claim 7 wherein said light emitter comprises an organic light emitting diode.

9. The display device of claim 1 wherein said optical part comprises a reflector.

10. The display device of claim 9 wherein said reflector comprises a digital micro-mirror.

11. The display device of claim 10 wherein said reflector comprises a diffractive light device.

12. The display device of claim 1, wherein outputs of data latches in the plurality of pixels are applied simultaneously to their analog to digital converters in accordance with a global load signal.

13. A display device comprising a plurality of pixels, each pixel in the display comprising:

a serial shifter that accepts a serial bit stream and has an n-bit wide output;

an n-bit wide data latch that latches data received from the output of the serial shifter;

a digital to analog converter to which output of the data latch is applied; and an optical part driven by the digital to analog converter, wherein each pixel includes a plurality of optical parts, and wherein each pixel comprises:

a serial shifter corresponding to each optical part;

a data latch corresponding to each optical part;

a single digital to analog converter;

a first switch to selectively and individually apply the output of the pixel's data latches to the single digital to analog converter; and a second switch to selectively and individually apply the output of the single analog to digital converter to the plurality of optical parts.

14. The display device of claim 13, wherein serial shifters in each pixel are arranged to receive data in parallel.

* * * * *